US008082693B2

(12) United States Patent
Marocco

(10) Patent No.: US 8,082,693 B2
(45) Date of Patent: Dec. 27, 2011

(54) ARCH SHUTTER

(76) Inventor: Mario M Marocco, Toronto (CA)

( * ) Notice: Subject to any disclaimer, the term of this patent is extended or adjusted under 35 U.S.C. 154(b) by 594 days.

(21) Appl. No.: 12/289,698

(22) Filed: Oct. 31, 2008

(65) Prior Publication Data

US 2010/0107538 A1 May 6, 2010

(51) Int. Cl.
*E06B 7/08* (2006.01)

(52) U.S. Cl. ..... 49/74.1; 49/92.1; 49/403

(58) Field of Classification Search ..... 49/74.1, 49/92.1, 403; 52/202, 203, 199, 473, 75, 52/76; 160/236
See application file for complete search history.

(56) References Cited

U.S. PATENT DOCUMENTS

| | | | | | |
|---|---|---|---|---|---|
| 16,632 | A * | 2/1857 | Livingston | 49/91.1 |
| RE4,773 | E * | 2/1872 | Young | 49/74.1 |
| 2,962,956 | A * | 12/1960 | Magyar | 454/281 |
| 3,290,823 | A * | 12/1966 | Matsuichi | 49/403 |
| 3,302,692 | A * | 2/1967 | Grau | 160/133 |
| 4,292,763 | A * | 10/1981 | Barnes et al. | 49/64 |
| 4,509,290 | A * | 4/1985 | Stanfield, Jr. | 49/91.1 |
| 6,341,447 | B1 * | 1/2002 | Jean | 49/74.1 |
| 6,758,256 | B1 * | 7/2004 | Garcia | 160/134 |
| 6,877,546 | B1 * | 4/2005 | Garcia | 160/134 |
| 7,254,899 | B2 | 8/2007 | Marocco et al. | |
| 2002/0026749 | A1 * | 3/2002 | Lee | 49/74.1 |
| 2005/0204631 | A1 * | 9/2005 | Cabrera | 49/86.1 |
| 2005/0284023 | A1 * | 12/2005 | O'Hair | 49/74.1 |
| 2006/0101717 | A1 * | 5/2006 | Marocco | 49/74.1 |
| 2006/0248801 | A1 | 11/2006 | Marocco | |
| 2008/0092444 | A1 * | 4/2008 | Yang | 49/92.1 |
| 2009/0293400 | A1 * | 12/2009 | Fraser | 52/473 |
| 2011/0083370 | A1 * | 4/2011 | Stone | 49/82.1 |

* cited by examiner

*Primary Examiner* — Jerry Redman

(57) ABSTRACT

An arch shutter having a frame with an arch frame portion, and often with a linear lower frame portion, and louvres extending from side to side of the arch portion, parallel to the linear lower frame portion, and having a frame section of predetermined width, and bevel portions formed at each end of each louvre, the bevel portions removing a portion at each end of each louvre for providing clearance for rotation of each louvre without interfering with arch frame portion, and pivot pins inserted through drillings in the frame from the exterior.

8 Claims, 7 Drawing Sheets

ARCH SHUTTER

FIELD OF THE INVENTION

The invention relates to shutters for window openings, and in particular to an arch shutter for an arch window, such as an arcuate shaped opening above a door way for example.

BACKGROUND OF THE INVENTION

Regular windows have frames which are generally rectangular. Shutters for such windows have been known for years. Such shutters have louvres which can be tilted between open and closed positions, for lighting or privacy.

However window openings are sometimes made with an arch shape. Typically such windows are known as fan lights. Usually, though not necessarily, such arch windows are located at the top of a doorway, but can be located anywhere depending on the design of the building.

Arch shutters, for fitting in such arch window frames are difficult to make. Clearly it is desirable that such an arch shutter shall have louvres, similar to regular shutters, and that the louvres shall be capable of being tilted between open and closed positions. Making an arch frame to match the window frame, is a first problem.

One problem is that the ends of the louvres should fit snugly against the inside of the arch frame. One solution proposed has been to secure fixed generally triangular shaped panels inside the frame. The louvres can simply abut against the vertical edges of the panels.

This is unsightly and closes off part of the arch frame so that no light can go through. If it is attempted to extend the louvres right out to the inside of the arch frame, then the curve or angle of the arch will interfere with the ends of the louvres, restrict tilting of the louvres, so that they can never be tilted fully closed. It was attempted to solve this by providing each louvre with a pivot axis located along one edge of each louvre. This was unsightly. Another problem is that the louvres must be positioned on centres which are spaced apart around the arch frame, but are spaced apart from each other by linear distances corresponding to somewhat less than the width of each louvre.

This arrangement can be difficult to achieve, in view of the fact that the arch frame, if it is an arcuate arch, curves progressively, at a greater and greater angle from the lower edge to the apex of the arch.

Another problem arises because the louvres usually made of wood, or plastic extrusion, or the like. They have an aerofoil shape in section, and have a relatively slender cross section. The ends of the louvres must receive pivot pins of some kind. Drillings for such pins must therefor be made into each end of each louvre.

However since the louvres have a slim cross section, the pins and the drillings must also be of small diameter. The pins are also received in small diameter drillings made in the side frame or arch frame. These drillings will be made diagonal to the section of the frame. In the past attempts have been made to drill such bores only from the inside of the frame. However this makes assembly of the shutter complex. Pins must somehow be inserted into the frame and the louvres, and this is difficult.

It would be preferable to drill from the outside and insert the pins right through the frame. However drills of small diameter are not suitable for drilling long holes right through the frame, diagonal to its axis. A solution must be found to this problem.

BRIEF SUMMARY OF THE INVENTION

With a view to solving these conflicting problems, the invention provides an arch shutter having a frame with an arch portion, and usually with a linear lower frame portion, and louvres extending from side to side of the arch portion, parallel to the linear lower frame portion, and comprising, a frame section of predetermined width, louvres extending across the frame, and bevel portions formed at each end of each louvre, said bevel portions removing a portion at each said end of each louvre for providing clearance for rotation of each said louvre without interfering with said frame portion.

It is a further objective to provide such an arch shutter in which the louvres have pivot axes located substantially along the central axis of each louvre, thereby providing a more aesthetically pleasing appearance.

It is a further objective to provide such an arch shutter in which the louvres have pivot pin drillings along their pivot axes, and in which the arch frame has pivot pin openings, oblique to the axis of the arch frame.

It is a further objective to provide such an arch shutter in which the arch frame pivot pin openings have a first predetermined diameter corresponding to the diameter of the pivot pins, and having counter bores partly extending into said arch frame, having a second predetermined diameter greater than said first diameter.

It is a further objective to provide such an arch shutter in which at least one of the pivot pins has a resilient sleeve thereon, frictionally engaging said pin and fitting within said counterbore.

It is a further objective to provide such an arch shutter in which the arch frame has a inner surface and an outer surface, and including a contoured strip on said inner surface, with generally wedge shaped formations.

It is a further objective to provide such an arch shutter in which the arch frame has an outer finish strip extending there around for covering said counter bores.

For the purpose of this explanation the phrase "arch frame" is intended to encompass shutters with a frame which is non rectangular. Thus such a frame can have an arcuate portion, or an angular linear portion, or can be circular, or a multi sided shape, or polygon, such as a hexagon, octagon, or having a portion which is part of a rectangle, and another portion which is not.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
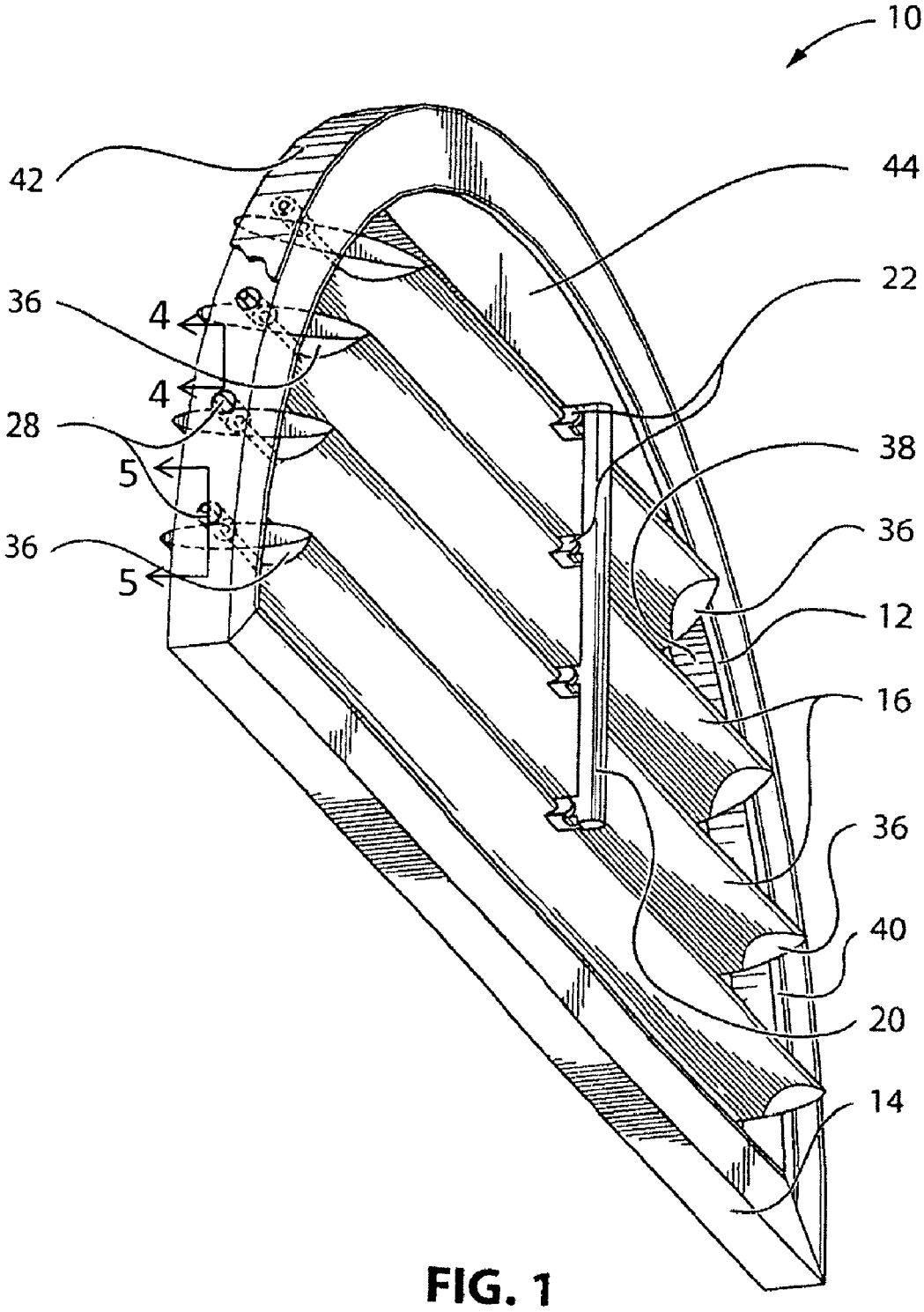
FIG. 1 is a perspective of an arch shutter illustrating the invention.
Figure 2:
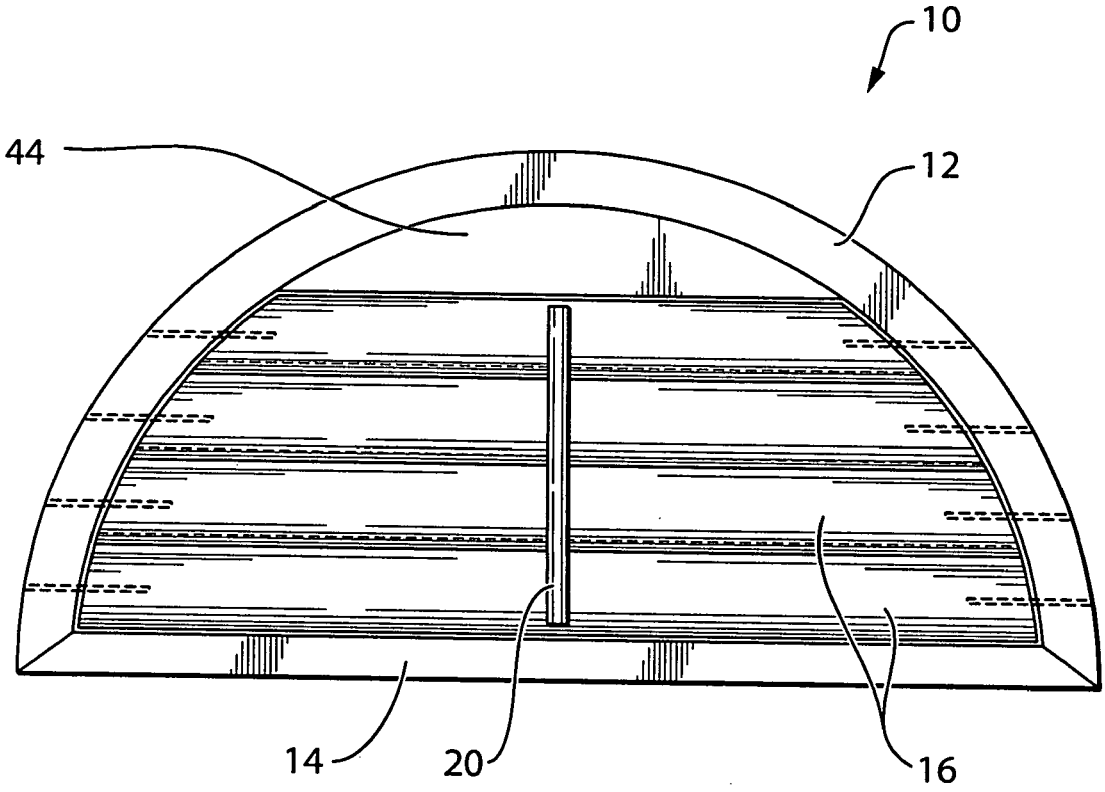
FIG. 2 is an elevation of the arch shutter of FIG. 1.
Figure 3:
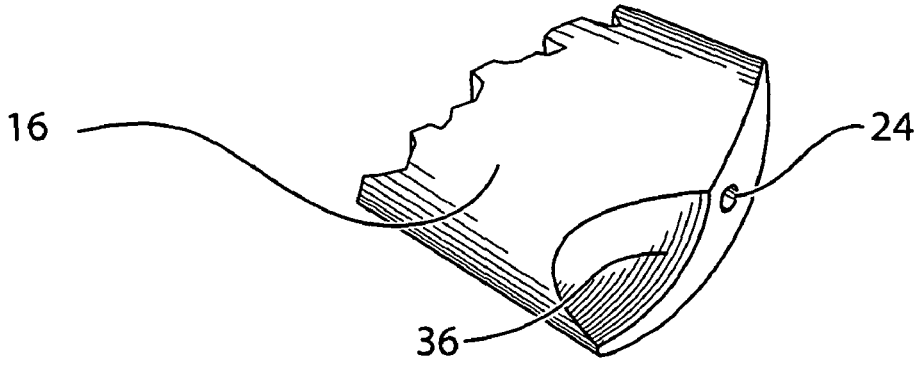
FIG. 3 is a perspective of one end of a louvre.
Figure 4:
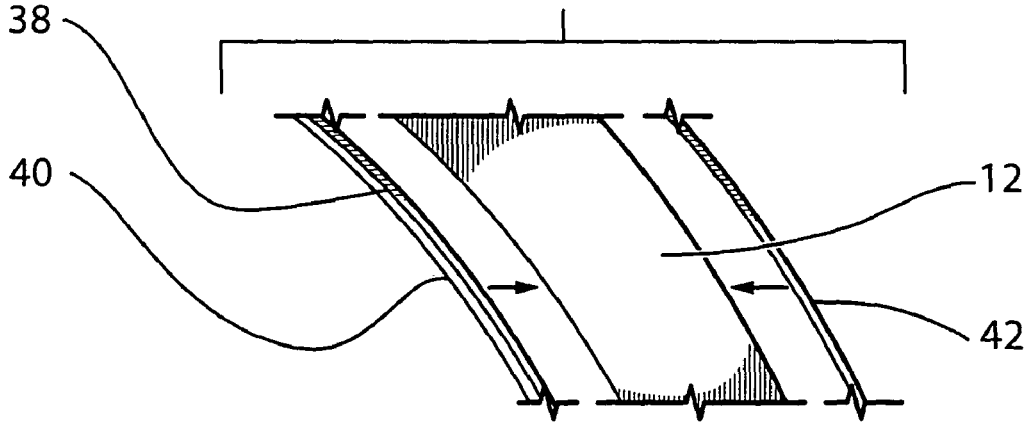
FIG. 4 is an exploded elevation of the arch frame.
Figure 5:
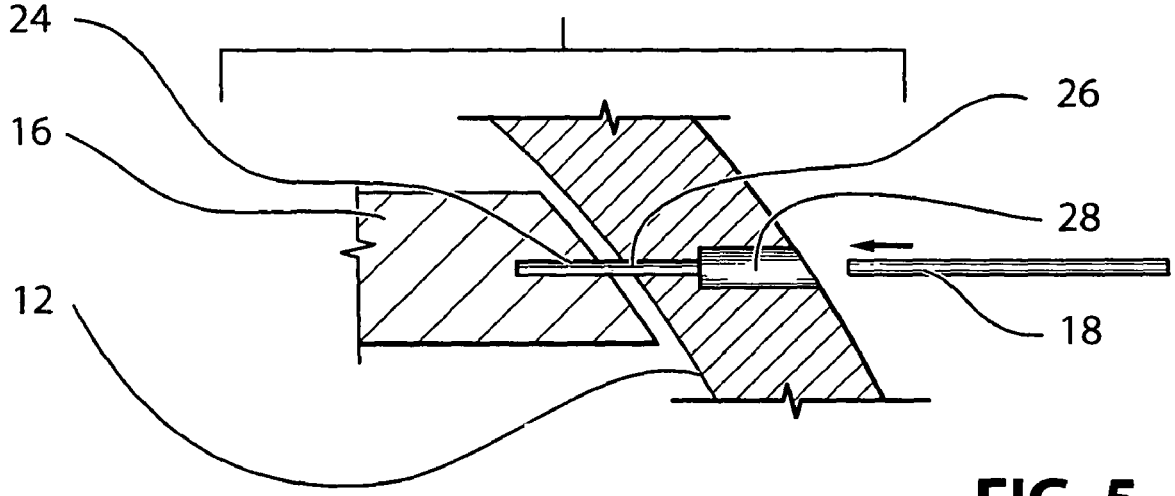
FIG. 5 is an exploded elevation of the pivot pin and resilient sleeve
Figure 6:
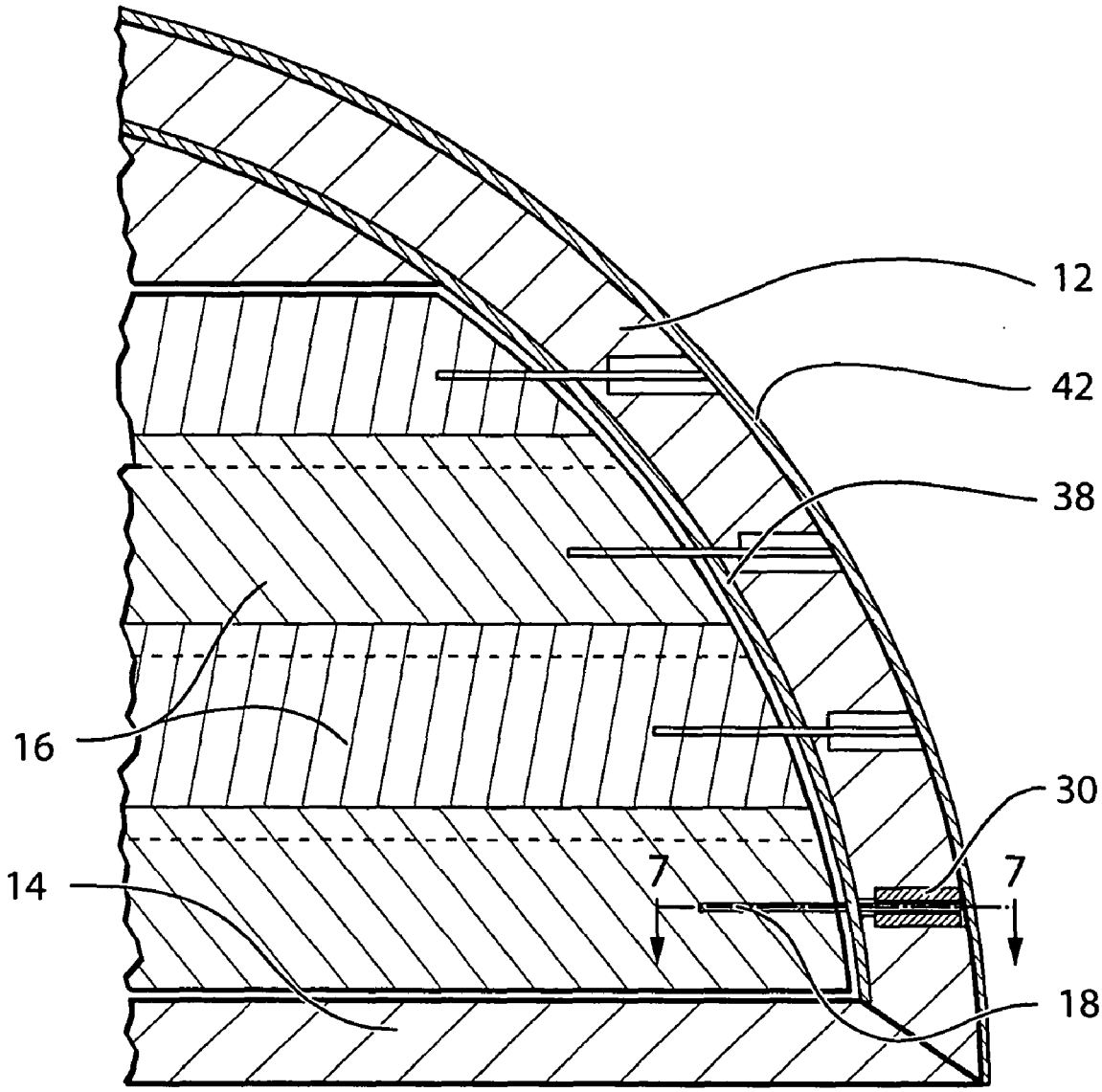
FIG. 6 is a section of the arch frame, showing the pivot pins and resilient sleeves.

Referring to FIGS. 1 and 2 it will be seen that there is illustrated an arch shutter (10), designed typically to fit in or over an arch window opening (not shown), such as a fan light over a doorway, for example, though there may be many other locations other than doorways where such arch shutter (10) can be used to advantage. The arch shutter (10) has an arch frame portion (12) which is generally arcuate in shape, and has a lower cross bar (14) extending from end to end of arch frame portion (12).

This is the typical shape. However it will be appreciated that shutters may be made in a variety of shapes to fit windows of different designs. Such window designs may be simply circular, or oval, or the arch may be more or less than a semi-circle.

The frame may be of eccentric shape, such as a triangle or a polygon.

Various different shapes of frames for shutters are shown in FIGS. 8, 9, 10, and 11, by way of example and without limitation.

The frame may be formed of extruded thermoplastic material, which can then be formed into a curved arcuate shape if that is desired.

Figure 12:
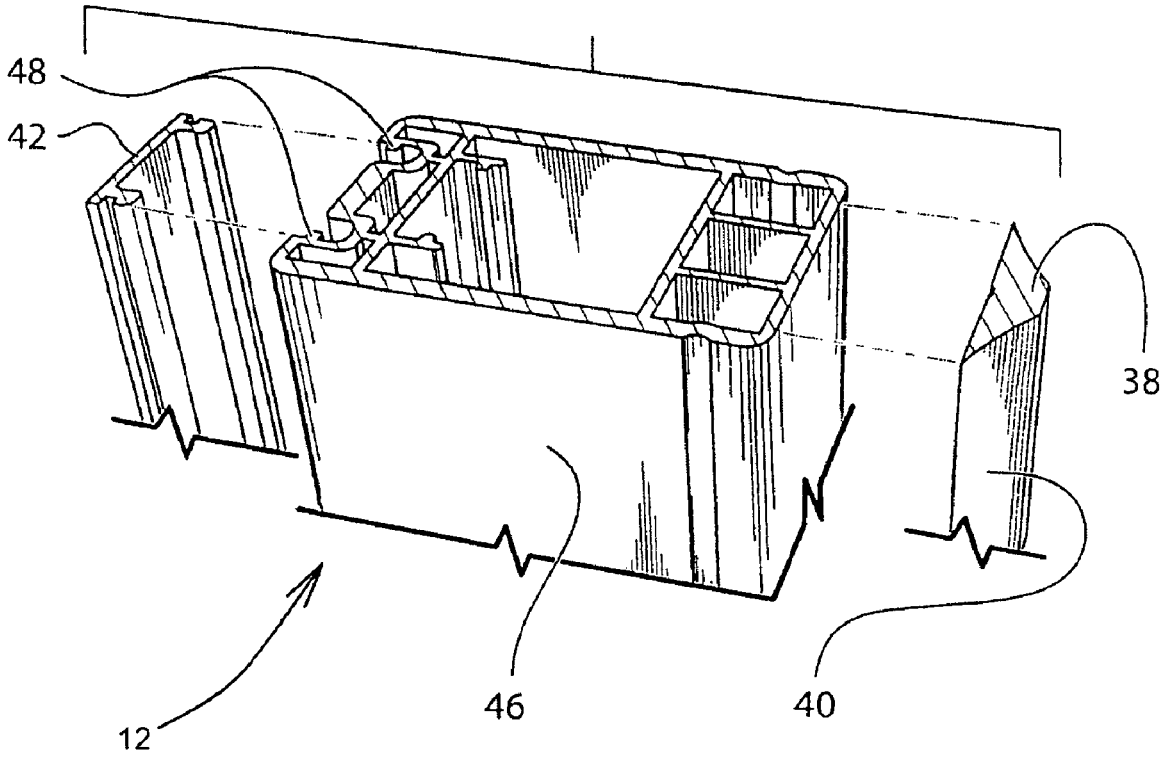

One form of hollow section for the frame is shown in FIG. 12, described below.

In order to close off and open up the window space, the arch frame portion (12) carries a series of louvres (16). The louvres (16) are similar to louvres of conventional shutters in several ways.

They are usually made of wood, or plastic extrusion, or the like. They have an aerofoil shape in section, and are relatively slim, so as to provide minimum obstruction to light, when swung open. Each louvre (16) is rotatably mounted on pivot pins (18) at each end.

The louvres (16) are connected together by a louvre control bar (20) which is pivotally connected to each of them, by connectors (22). Various such connectors are known and require no description.

The pivot pins (18) are long and of small diameter, and make a friction fit in louvre pivot drillings (24) in each end of each louvre (16).

Such pivot pins (18) are preferably inserted into the frame from the exterior, and are then inserted into the ends of each louvre (16). This greatly simplifies assembly of the shutter. For this reason frame pivot drillings (26) are formed which are also of small diameter. The frame pivot drillings (26) are formed diagonal to the section of the arch frame portion (12).

Thus they traverse a long path through the arch frame portion (12). Drills of small diameter, and of sufficient length to pass diagonally through the arch frame portion (12) and then into the ends of the louvres (16), are inconvenient to use, even if it is possible to make them.

Such small diameter tools will tend to bend and provide holes which are not on precise centres.

In order to overcome this, frame counter bores (28) are formed, first from the exterior of the arch frame (12), and extending part way through, on the required diagonal axis.

Frame counter bores (28) are of much larger diameter than the frame pivot drillings (26), and can thus be maintained on precise centres, co axial with the axes of frame pivot drillings (26). They also permit a solution to another problem It is desirable to provide some form of frictional stability so as to control the positioning of the louvres (16). According to the invention this is achieved by placing at least one resilient sleeve (30) in at least one frame counter bore (26). The sleeve (30) will have an inner diameter which is bonded by adhesive (32) to one of the pivot pins (18). The exterior of the sleeve (30) will make a snug friction fit in the frame counter bore (26).

The end of the pivot pin (16) entering the louvre (16) will have ribs or knurling (34), which secure that louvre (16) to the pin and prevent rotation. Adhesive can also be used for the purpose.

In this way the positioning of the louvres (16) can be set by hand and will remain in that position until manually reset.

More than one such sleeve (30) can be provided if desired.

In order to allow the louvres (16) to rotate fully closed, without interfering with the arch frame, the louvres (16) have curved or angled ends and are cut way or bevelled as at bevel surfaces (36) at each end.

Figure 7:
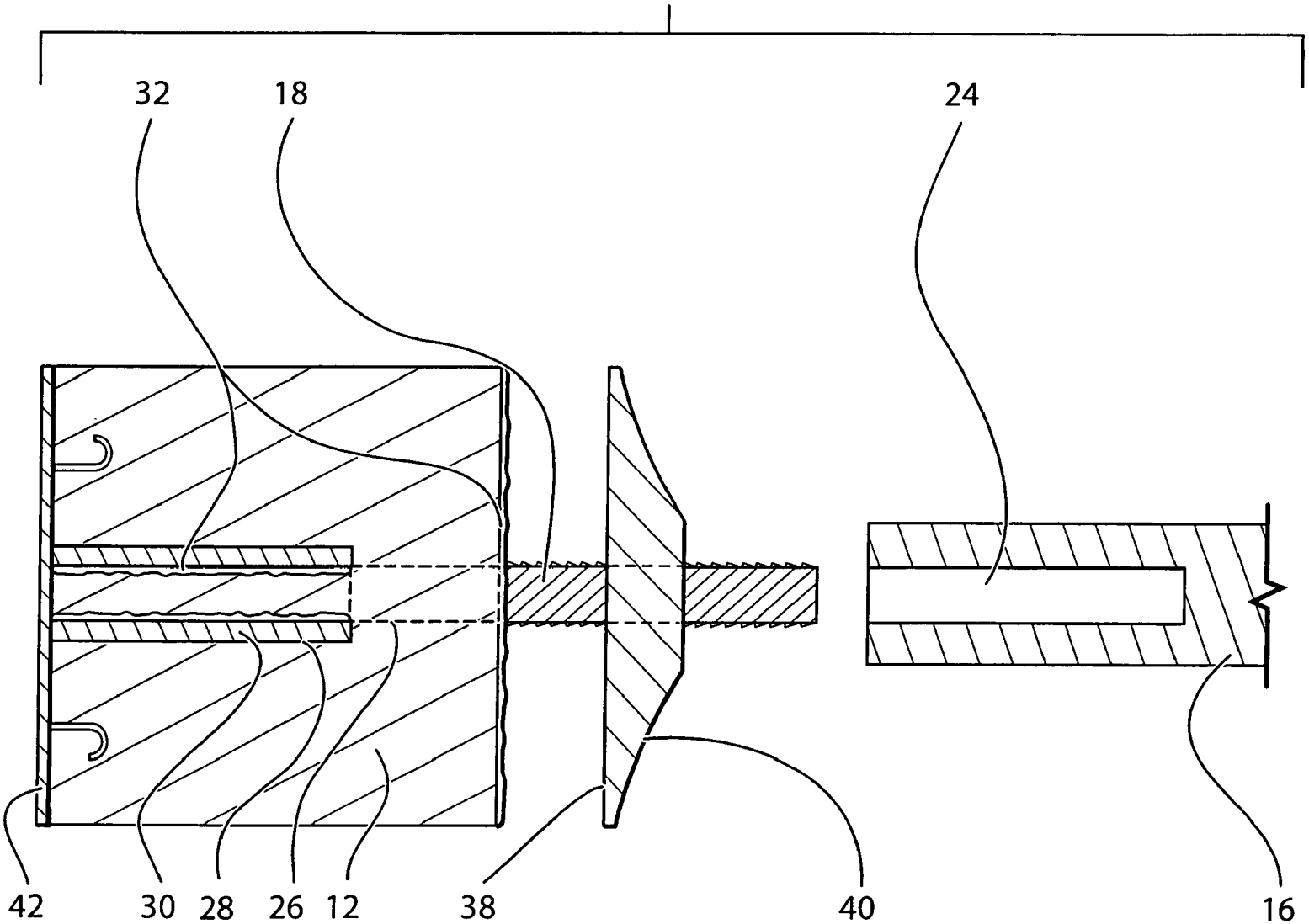
FIG. 7 is an exploded section along line 7-7 of FIG. 6.
Figure 8:
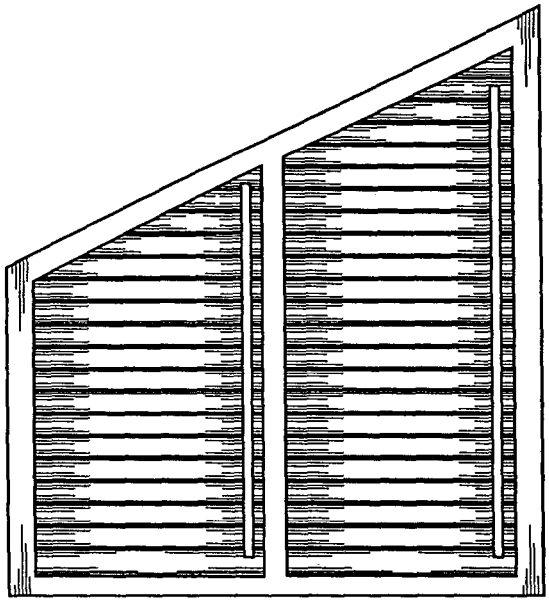
FIGS. 8, 9, 10 and 11, show various different shapes of arch shutter, without limitation to any such shape, and, FIG. 12 is a cut away prespective of one form of frame extrusion suitable for use with the invention, shown with the inner and outer trim exploded.
Figure 9:
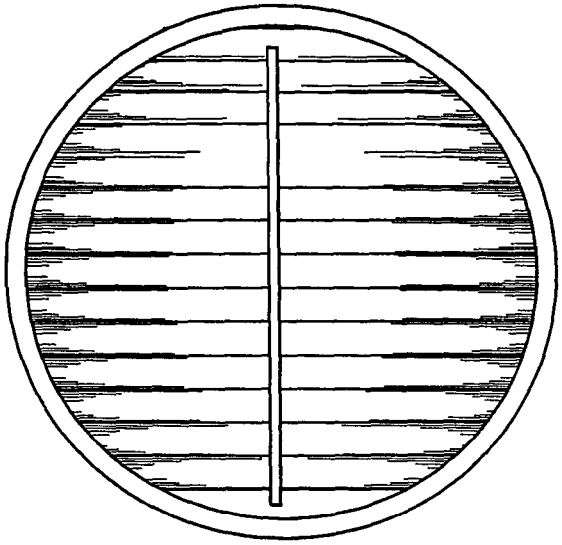
Figure 10:
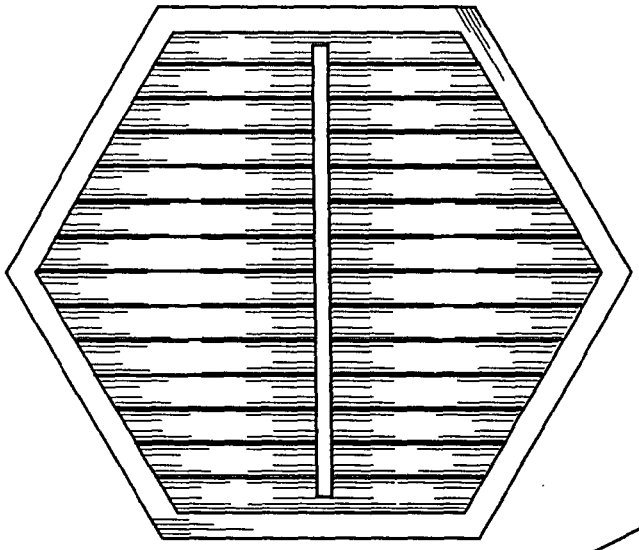
Figure 11:
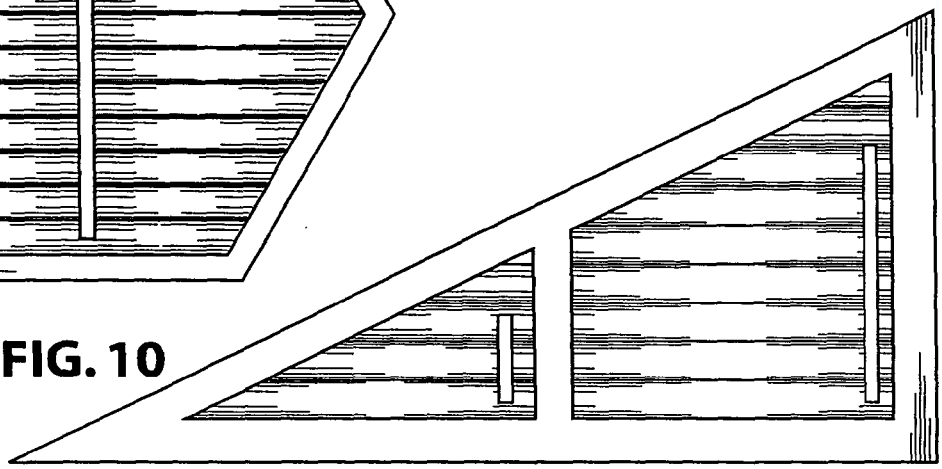

To further assist in closing of the louvres (16) there is an inner frame moulding (38) bonded to the inner side of the arch frame portion (12) (FIG. 7). Inner frame moulding (38) is approximately as wide as the arch frame portion (12) itself, and has wedge shaped shoulders (40), which provide further clearance for the ends of the louvres (16) when they are swung closed. Pivot pin passages are formed in the moulding (38), coaxial with the pivot pin drillings (26, to permit the pivot pins (18) to pass therethrough into the louvres (16).

The outer side of the arch frame portion (12) is provided with a cover strip (42) which closes off and conceals the open ends of the frame counter bores (26, and also functions to hold the pivot pins (18) in place.

The apex of the arch frame portion (12) has a fixed cross member (44, closing off the top.

The arch frame portion (12) can be a hollow extruded section (46) as shown in FIG. 12. This is particularly advantageous and permits the formation of channel lips (48) which can grip the outer trim (42). Other forms of frame section can be used in various circumstances.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An arch shutter having a frame and comprising;

an arch frame portion of predetermined arcuate shape, defining two ends, and an apex, and wherein said arch frame portion has an inner surface and an outer surface;

a contoured strip on said inner surface, with generally wedge shaped formations thereon;

louvres mounted in said arch frame portion having angled ends corresponding the shape of the arch frame portion;

pivot pin drillings in said louvres defining pivot axes, for receiving pivot pins, and wherein said arch frame portion defines a longitudinal axis and has pivot pin openings, oblique to said axis of said arch frame portion;

pin passages formed through said contoured strip coaxial with said pivot pin openings; and bevel portions formed at each end of each louvre, said bevel portions removing a portion at each said end of each louvre for providing clearance for rotation of each said louvre without interfering with said arch frame portion.

2. An arch shutter as claimed in claim 1 in which the louvres define pivot axes located substantially along a central axis of each louvre, thereby providing an aesthetically pleasing appearance.

3. An arch shutter as claimed in claim 1 wherein said arch frame pivot pin openings have a first predetermined diameter corresponding to the diameter of the pivot pins, and having frame counter bores partly extending into said arch frame portion, along said oblique axes, coaxial with said pivot pin openings, said frame counter bores having a second predetermined diameter greater than said first predetermined diameter, and pivot pins extending through said frame counter bores, and through said pivot pin openings and into said louvres.

4. An arch shutter as claimed in claim 3 wherein at least one of the pivot pins has a resilient sleeve thereon, said sleeve fitting around said pivot pin and fitting snugly in said frame counter bore .

5. An arch shutter as claimed in claim 4 wherein said arch frame portion has an outer finish strip extending there around for covering said frame counter bores .

6. An arch shutter as claimed in claim 1 wherein said arch frame portion is arcuate defining two ends, and an apex, and including a linear frame portion extending between said ends parallel to said louvres .

7. An arch shutter as claimed in claim 6 wherein said arch frame portion has a plurality of pivot pin openings therein at spaced intervals, and each defining a pivot axis parallel to said louvres, and wherein each said axis is oblique to said arch frame portion at angles progressively increasing from said arch frame ends towards said apex.

8. An arch shutter as claimed in claim 7 and including a top panel portion supported in said arch frame portion adjacent said apex thereof.

* * * * *